United States Patent [19]

Bessone et al.

[11] 4,146,820

[45] Mar. 27, 1979

[54] FLUORESCENT LAMP POWER REDUCER

[75] Inventors: Carlo S. Bessone, Cambridge; William J. Roche, Merrimac, both of Mass.

[73] Assignee: GTE Sylvania Incorporated, Danvers, Mass.

[21] Appl. No.: 850,614

[22] Filed: Nov. 11, 1977

[51] Int. Cl.[2] ..... H05B 37/00; H05B 39/00; H05B 41/14

[52] U.S. Cl. ..... 315/227 R; 315/DIG. 4; 315/240

[58] Field of Search ..... 315/58, 71, 74, 127, 315/207, 227, 240, DIG. 4, DIG. 5, 106

[56] References Cited

U.S. PATENT DOCUMENTS 3,956,665 5/1976 Westphal ..... 315/95

*Primary Examiner*—Alfred E. Smith
*Assistant Examiner*—Robert E. Wise
*Attorney, Agent, or Firm*—James Theodosopoulos

[57] ABSTRACT

A power reducer for a rapid start fluorescent lamp includes a time delay circuit that discontinues heater current to the lamp cathode after a predetermined time interval and places, at the same time, a current-reducing capacitor in series with the lamp.

6 Claims, 2 Drawing Figures

FLUORESCENT LAMP POWER REDUCER

THE INVENTION

This invention is concerned with reducing energy consumption in fluorescent lamps. U.S. Pat. No. 3,956,665, discloses one such method of reducing wattage consumption by replacing one of the lamps in a two lamp rapid start system with a so-called phantom tube. The phantom tube consists of a capacitor sealed within a glass or plastic tube. When the phantom tube replaces a lamp in a two lamp rapid start system, it preserves the series circuit, thus allowing the remaining lamp to light. A disadvantage of the phantom tube is that it cannot be used in a single lamp system. Another disadvantage is that its use results in an uneven light distribution, since the phantom tube produces no light of its own.

It is the purpose of this invention to provide a device for reducing fluorescent lamp energy consumption that eliminates said disadvantages. The device consists of a solid state electronic circuit which can be packaged into, say, a two inch base extender for use with a shortened fluorescent lamp as disclosed in copending application serial number 840,408, filed Oct. 7, 1977, the disclosure of which is incorporated herein by reference, or it can be packaged and installed as an add-on component inside a fluorescent lamp fixture.

In operation, in a rapid start system, once the lamps have ignited, the device will disconnect coil heat from one side of the wattage reducing lamp and insert a capacitor in series with the lamp. Since the capacitor is connected in series with the lamp, there is no safety hazard involved should someone accidentally touch one end of the lamp and circuit ground as in the phantom tube system. The capacitor is automatically disconnected from the pins of the lamp when the associated base is disconnected from the circuit or when the input voltage is turned off. There is no uneven light distribution in a two lamp system since both lamps continue to produce an equal amount of light output but at a lower level than their rated output.

Figure 1:
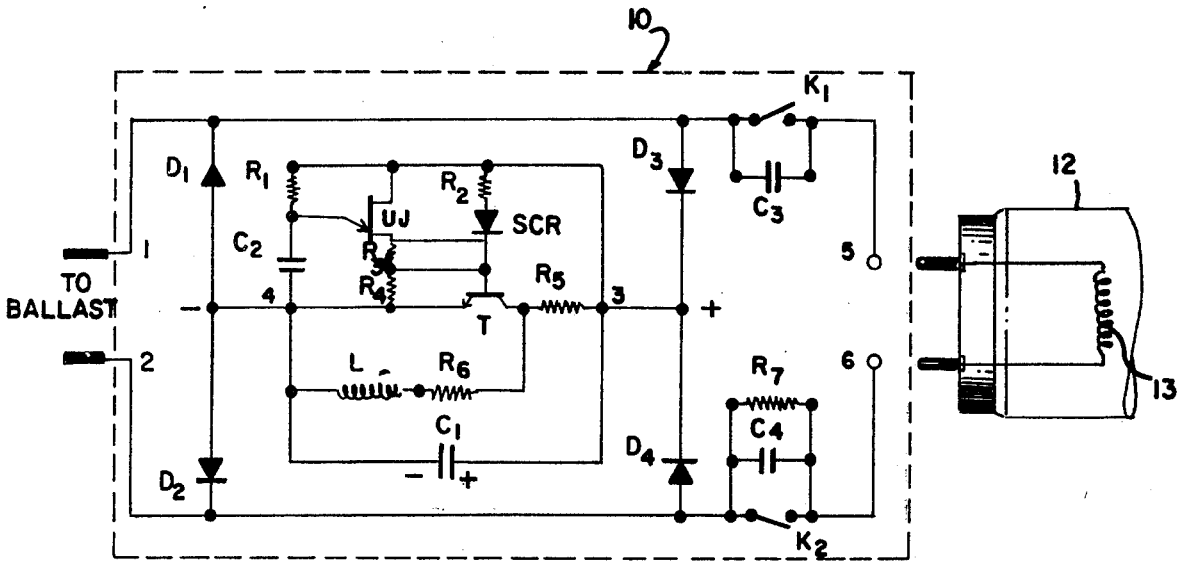
Figure 2:
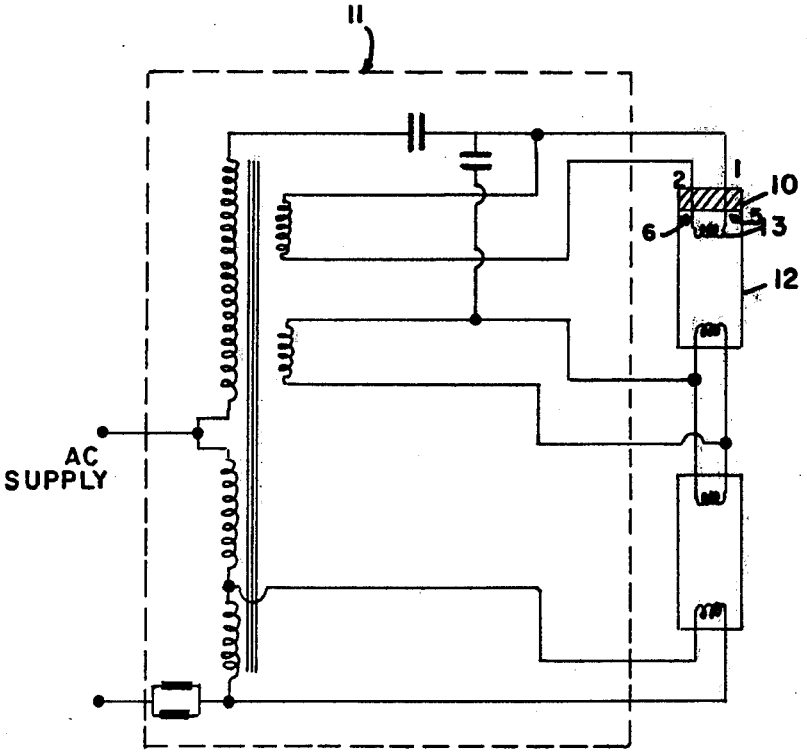

In the drawing, FIG. 1 shows the circuit diagram for one empodiment of the invention. FIG. 2 shows the invention in operation in a two lamp rapid start circuit.

As shown in the drawing, power reducing device 10 includes a bridge rectifier consisting of four diodes, $D_1$, $D_2$, $D_3$ and $D_4$, a filter capacitor $C_1$, two reed switches $K_1$ and $K_2$ both of which are simultaneously activated by coil winding L, a series capacitor $C_4$, an arc suppressing capacitor $C_3$, a silicon controlled rectifier SCR, an NPN switching transistor T, an unijunction transistor UJ, an RC timing circuit consisting of resistor $R_1$ and capacitor $C_2$, current limiting and biasing resistors $R_2$, $R_3$, $R_4$, $R_5$ and $R_6$, and bleeder resistor $R_7$.

When power is initially applied to ballast 11, a typical coil heat potential of 3.6 volts ac is seen at terminals 1 and 2. After this voltage is rectified by diodes $D_1$, $D_2$, $D_3$ and $D_4$ and filtered by $C_1$, a dc potential of approximately 5.0 volts is applied to terminals 3 and 4. Current flowing through $R_5$, $R_6$ and L causes the normally open reed relay contacts $K_1$ and $K_2$ to close. This applies the 3.6 volt ac coil heating voltage to terminals 5 and 6, and therefore to cathode coil 13, allowing lamp 12 to ignite in the usual manner.

Lamp current and coil heater current now flow from terminals 1 and 2 through switches $K_1$ and $K_2$ into lamp 12 through terminals 5 and 6.

After a predetermined amount of time, say, 3 or 4 seconds, has elapsed as a result of the charging rate of $C_2$ through $R_1$, unijunction transistor UJ causes a voltage pulse to be developed across $R_3$. This voltage causes a sufficient amount of gate current to turn on silicon controlled rectifier SCR. Consequently a large current flow from terminal 3 through $R_2$ and SCR into the base of switching transistor T. As a result of this base drive, transistor T is turned on, shunting relay coil L. This action causes switches $K_1$ and $K_2$ to open.

Lamp current is now forced to flow from terminal 2 through series capacitor $C_4$ to terminal 6 and into lamp 12. Since capacitor $C_3$ is a high impedance, circulating heater current to coil 13 is essentially eliminated.

When power to ballast 11 is discontinued, the voltage developed across $C_4$ dissipates through resistor $R_7$; in addition, switches $K_1$ and $K_2$ return to their normally open position.

In a specific example, the four diodes were Type IN4004. Capacitor $C_1$ was rated at 1000 microfarads, 16 volts; $C_2$ was rated at 47 microfarads, 16 volts and $C_3$ was rated 0.1 microfarads, 250 volts. The resistors were as follows: $R_1$–27 kilohms, ⅛ watt; $R_2$–100 ohm, ¼ watt; $R_3$–470 ohm, ⅛ watt; $R_4$–100 ohm, ¼ watt; $R_5$–15 ohm, 2 watt; $R_6$–15 ohm, ⅛ watt; $R_7$–22 kilohm, ¼ watt. Silicon controlled rectifier SCR was type MCR103, switching transistor T was type 2N3904 and unijunction transistor UJ was type 2N2647. Reed switches $K_1$ and $K_2$ were Hamlin MSRR-2-185 and coil winding L consisted of 500 turns of #30 wire around $K_1$ and $K_2$.

The valve of $C_4$ determines how much energy reduction occurs. For example, a two lamp 40 watt rapid start circuit at 120 volts input voltage had the following parameters; 781 ma input current; 93 watts input wattage; 378 ma lamp current; relative light output of 100%. When a power reducer as per this invention was inserted in the circuit using a capacitor $C_4$ rated at 10 microfarads, 250 volts, the following parameters were obtained; 622 ma input current; 72 watt input wattage; 275 ma lamp current; relative light output of 77.6%. With a capacitor $C_4$ of 3.3 microfarads, 250 volts, the following parameters were obtained; 503 ma input current; 53.4 watts input wattage; 180 ma lamp current; relative light output of 52.9%. Thus the 10 microfarad capacitor reduced the wattage consumption by 22.6% and the light output by 22.4%. The 3.3 microfarad capacitor reduced the wattage consumption by 42.6% and the light output by 47.1%.

We claim:

1. A power reducer for a fluorescent lamp comprising: cathode supply circuit means for supplying heater current to the cathode coil of a rapid start fluorescent lamp upon electrical energization of the lamp; impedance circuit means for inserting a current-reducing capacitor in series with said fluorescent lamp; time delay circuit means for disconnecting said cathode supply circuit means from said cathode coil and for connecting said impedance circuit means to said fluorescent lamp upon a predetermined time interval after said electrical energization.

2. The combination of the power reducer of claim 1 and a shortened fluorescent lamp, the power reducer being disposed within a base extender fastened to the end of the shortened lamp.

3. The power reducer of claim 1 wherein the cathode supply circuit means includes a high impedance capacitor, having a switch in parallel therewith, in series with the cathode coil.

4. The power reducer of claim 3 wherein said switch closes at the time of said electrical energization and opens at said predetermined time interval.

5. The power reducer of claim 4 wherein said cathode supply circuit means includes a diode bridge rectifier having a coil winding in the output circuit thereof, said coil winding encircling said switch.

6. The power reducer of claim 1 wherein said cathode supply circuit means includes a diode bridge rectifier having a coil winding in the dc output circuit of the rectifier, the coil winding encircling a switch which is in parallel with said current reducing capacitor, and wherein said time delay circuit means includes a switching transistor shunting the coil winding, the switching transistor being activated by a timing circuit that includes a resistor-capacitor combination, a unijunction transistor and a silicon controlled rectifier.

* * * * *